United States Patent [19]

Jansson

[11] Patent Number: 4,655,738

[45] Date of Patent: Apr. 7, 1987

[54] APPARATUS FOR THE MANUFACTURE OF A TUBULAR CONTAINER SLEEVE

[75] Inventor: Tage Jansson, Jarfalla, Sweden

[73] Assignee: Esselte Pac Aktiebolag, Jarfalla, Sweden

[21] Appl. No.: 740,267

[22] PCT Filed: Sep. 28, 1984

[86] PCT No.: PCT/SE84/00320

§ 371 Date: May 24, 1985

§ 102(e) Date: May 24, 1985

[87] PCT Pub. No.: WO85/01692

PCT Pub. Date: Apr. 25, 1985

[30] Foreign Application Priority Data

Oct. 20, 1983 [SE] Sweden ..... 83057844

[51] Int. Cl.[4] ..... B31C 1/00; B31B 1/52

[52] U.S. Cl. ..... 493/269; 493/304; 493/466; 53/563

[58] Field of Search ..... 493/269, 295, 308, 304, 493/466; 53/215, 563, 584, 589

[56] References Cited

U.S. PATENT DOCUMENTS 2,473,275 6/1949 Brouns ..... 53/584
3,603,220 9/1971 Myers ..... 493/269
4,349,345 9/1982 Bodendoerfer ..... 493/295

FOREIGN PATENT DOCUMENTS 2305702 2/1973 Fed. Rep. of Germany .
2906592 8/1980 Fed. Rep. of Germany .
2928773 9/1982 Fed. Rep. of Germany .

*Primary Examiner*—Frederick R. Schmidt
*Assistant Examiner*—William E. Terrell
*Attorney, Agent, or Firm*—James E. Nilles

[57] ABSTRACT

In apparatus for manufacturing tubular container sleeves, a blank is wrapped around a fixed mandrel by means of a pair of sweeper arms that are swingable and movable in translation. In each sleeve forming operation the sweeper arms are displaced from a position in which both are wholly at one side of the mandrel to a position in which they embrace the mandrel, each having an inner pivoted end at that one side of the mandrel and an outer swinging end at the other side of the mandrel. During at least the final half of each such displacement the outer ends of the sweeper arms maintain constant engagement against the mandrel through the blank. During the first half of that displacement the blank is progressively engaged against the mandrel by a sweeper band extending under tension between the outer ends of the sweeper arms.

4 Claims, 5 Drawing Figures

APPARATUS FOR THE MANUFACTURE OF A TUBULAR CONTAINER SLEEVE

Figure 1:
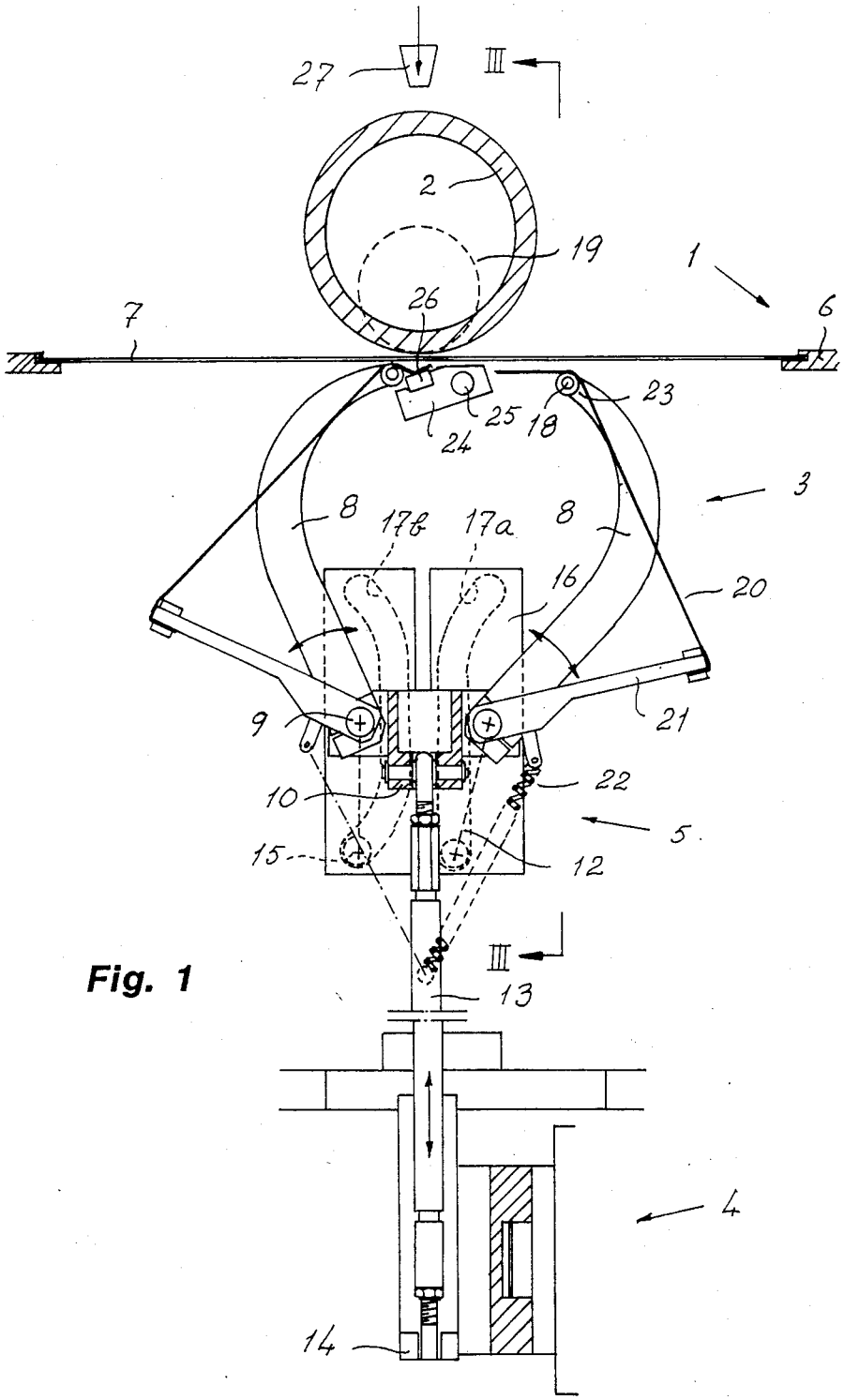

The present invention generally relates to the manufacture of containers, and the invention is more particularly directed to an apparatus for the manufacture of tubular container sleeves from a plane blank of cardboard, plastic, sheet metal, a thin laminated material or a similar material.

In the manufacture of certain types of containers, especially containers of rounded shapes such as containers having rounded corners or having a circular, elliptical or similar cross section, it has been customery to make a container sleeve which is closed at one end and which is filled with the material to be packed and thereafter closed at the opposite end.

The container sleeve can be manufactured in several different ways. The sleeve can be made by sprayforming or dieforming a plastic material or by winding a material spirally onto a mandrel whereafter the tube may be cut at the ends to a suitable length. This is a timeconsuming method which is not suitable for use in direct connection with the filling and the closing of the container, and the premanufactured container sleeves are bulky, and in many cases the container sleeves must be sterilized before being filled with the material to be packed. The latter method also gives a container which for many types of goods is not sufficiently liquid- and gasproof. Therefore there is a wish that the container sleeve be made in direct connection with the filling and the closing of the container, whereby the container sleeve should be made from a plane blank of cardboard, plastic, any laminated material, sheet metal or a similar material.

The formation of a container sleeve having rounded form, for instance rounded corners or having a circular, elliptical or otherwise rounded cross-section, causes some problems which are directly dependent on the fact that the container sleeve must have a carefully calculated inner size so that the bottom and top closures can be connected to the container sleeve to provide a well-sealed container. This is especially important in containers having inner bottom and top closures.

Several different methods are known in the art for making a container sleeve from a plane blank of cardboard or a similar material.

The German patent DE No. 29 28 773 discloses a method in which the sleeve is made inside an outer fixed mandrel by means of press semicylinders acting from inside the sleeve and thereafter possibly by means of concave press rollers acting from outside. This method is timeconsuming, expensive and complicated, the method is limited to a specific type and size of container and there are great demands on the fitting dimensions between the outer mandrel and the inner press semicylinders.

Therefore it is to preferred that the sleeve is formed from outside on an inner fixed mandrel, and such an outer formation method is disclosed in U.S. Pat. No. 4,349,345. The patent discusses the problems of having the container blank carefully fit and follow the mandrel at the rounded corners, and in this patent the formation problems have been solved by means of outer fixed formation jaws which at the upper rounded corners of the container provide a special compression of the corners by means of rotatably mounted wings. Also this apparatus is disadvantageous in that the method is limited to a specific type and size of the container sleeve and that it is important that the inner mandrel and the outer jaws carefully fit each other and the method is relatively slow, and the costs for the mandrel and the jaws are relatively high.

The German laid open publication DOS No. 23 05 702 discloses a method in which a container sleeve is made on a fixed inner mandrel by means of an elastic ribbon acting between two rotatable arms. Since the tension of the elastic ribbon is increasing as the arms are folded up and round the fixed mandrel the tension of the folding or sweeping ribbon is strongly changed during the formation and this may lead to stretchings and tensions in the container blank so that the container sleeve after having been removed from the mandrel may shrink or wrinkle or may be otherwise deformed.

The German laid open publication DOS No. 29 06 592 discloses an alternative method using a non-elastic sweeping band which is kept stretched by a tension spring operating between the band ends and in which a pair of rotatable arms are adapted to fold the band together with the sleeve blank round a fixed inner mandrel. In the sweeping process the arms are rotated about fixed shafts in relation to the mandrel. Also in this apparatus stretchings or tensions may be transmitted from the band to the container blank in that the band ends are freely connected to each other through a tension spring so that the band can move on the rotatable arms during the entire sweeping movement. When the sleeve blank is swept round the mandrel quantities of air may be enclosed which can not be pressed out by the spring loaded band.

All described apparatus are disadvantageous in that they only allow the manufacture of sleeves having a specific shape and size and in that other shapes or sizes of sleeves can be made only after a substantial rebuilding of the machine.

The object of the invention therefore is to solve the problem of providing an apparatus of the above mentioned type in which the sleeve blank is carefully conformed to the inner mandrel without the risk of stretchings and tensions of the blank and without the risk that quantities of air will be enclosed between the sleeve blank and the mandrel and without the risk that the finished container sleeve will wrinkle or be subjected to tensions. A further object of the invention is to provide an apparatus for the manufacture of a container sleeve which apparatus may quickly and simply be readjusted for the manufacture of sleeves having different shapes and different sizes, especially by replacing the inner mandrel and simply readjusting the scheme of movement for the available sweeping arms.

Therefore the invention relates to an apparatus for the manufacture of tubular container sleeves having rounded shapes and made of cardboard, plastic, sheet metal, any laminated material etc. from a plane sleeve blank and comprising a fixed mandrel around which the sleeve blank is intended to be swept and sealed to an integral container sleeve, two sweeping arms over which a spring loaded sweeping band extends, and means for rotating the sweeping arms together with the plane sleeve blank round the mandrel, and means for securing the sleeve blank in the sleeve shape thereby provided.

The most characterizing part of the invention is that the sweeping arms together with their swinging axes are displaceable in relation to the mandrel at the same time as they are rotated about their shafts so that the free ends of the arms during the sweeping operation slide along or close to the mandrel while successively pressing the sleeve blank to the mandrel. The successive displacement of the ends of the sweeping arms over the mandrel may be started anywhere from the line where the sleeve blank gets into contact with the mandrel to a line located at some distance therefrom, but usually it is sufficient that the contact between the arm ends and the mandrel is started from a place at or close to the central line of the mandrel.

In a preferred embodiment of the invention the sweeping arms are positively guided in their movement by means of guide grooves, whereby any wanted container shape can be obtained.

By a simple readjustment of the length of stroke and the sweeping movement for the sweeping arms and a simple exchange of mandrel the apparatus according to the invention can easily be adapted to the manufacture of container sleeve of different sizes and different shapes.

Further characteristics of the invention will be evident from the following detailed description in which reference will be made to the accompanying drawings.

It is, however, to be understood that the illustrated and described embodiments of the invention are only illustrating examples and that many different modifications may be presented within the scope of the appended claims.

Figure 2:
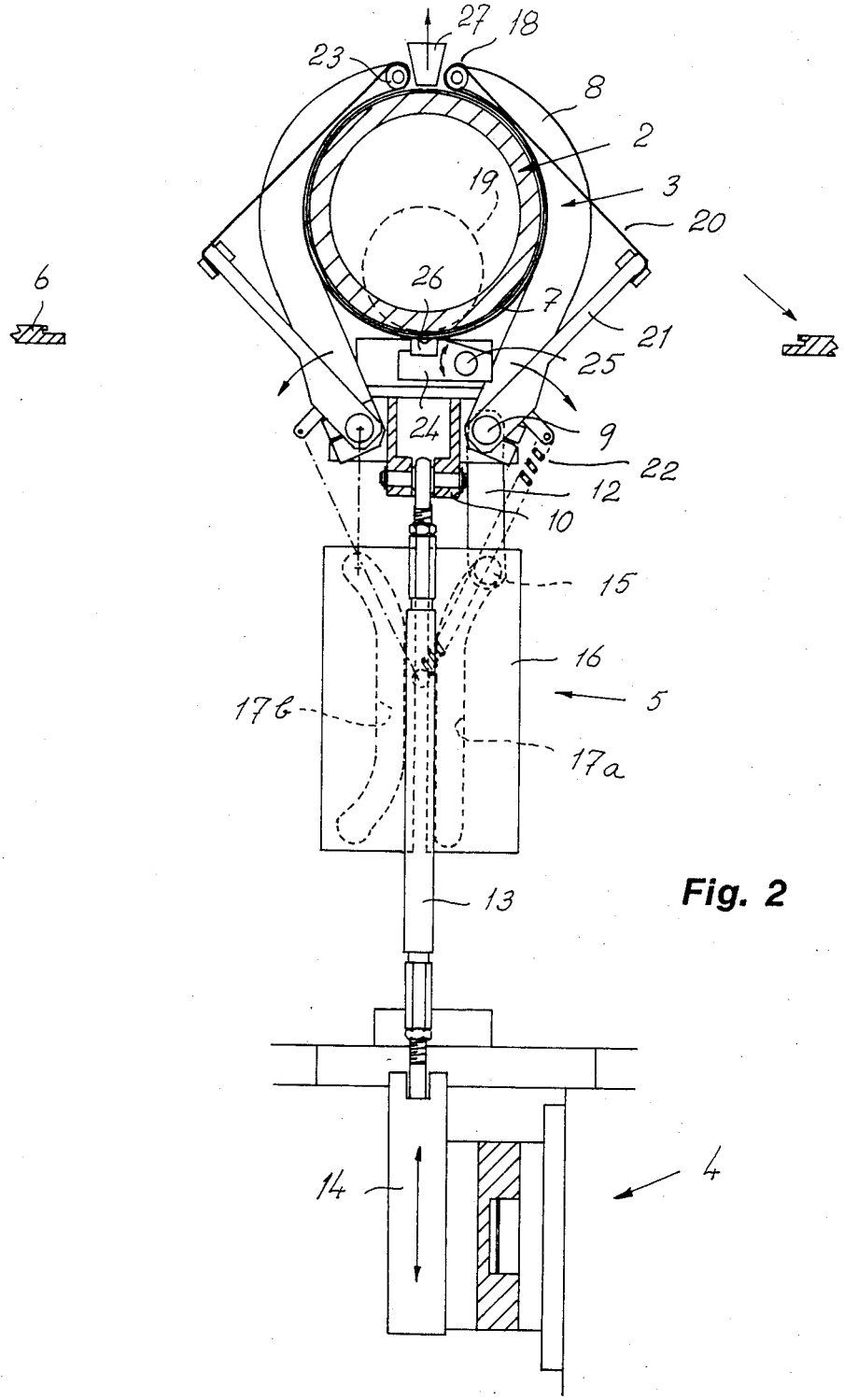
Figure 3:
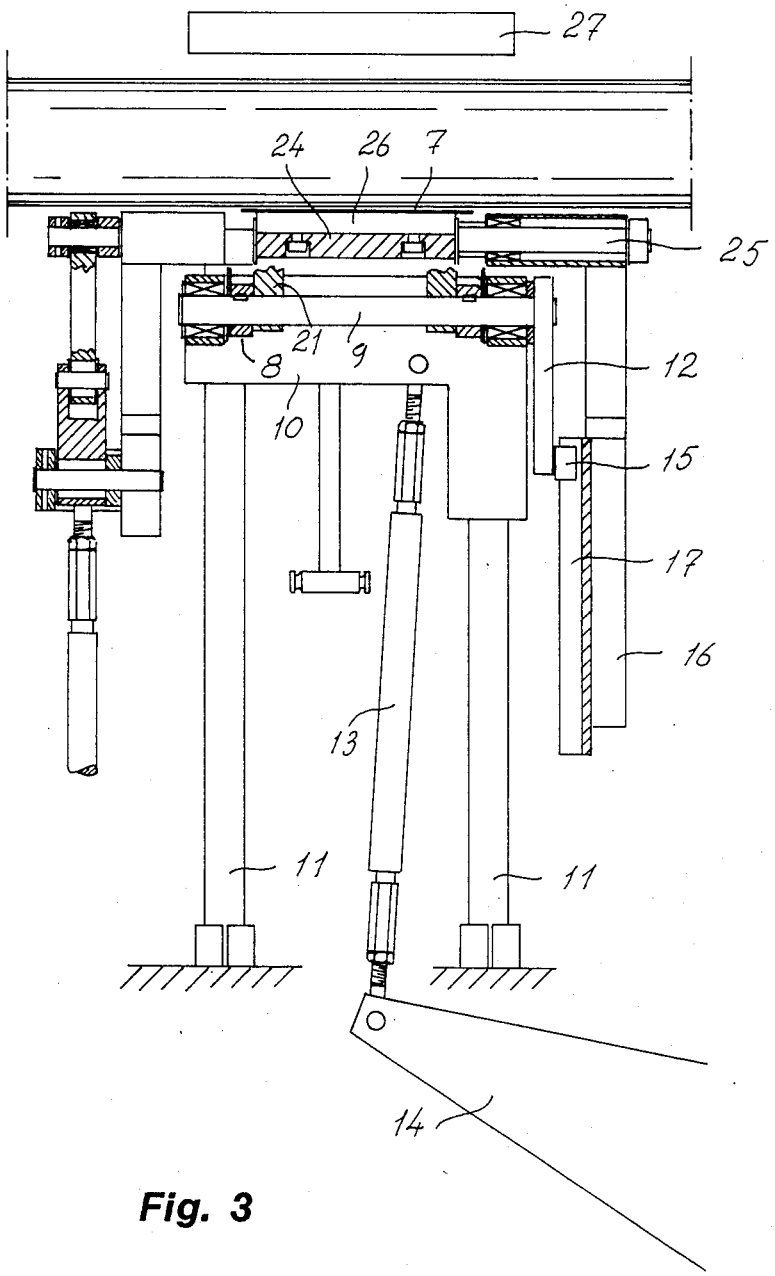
Figure 4:
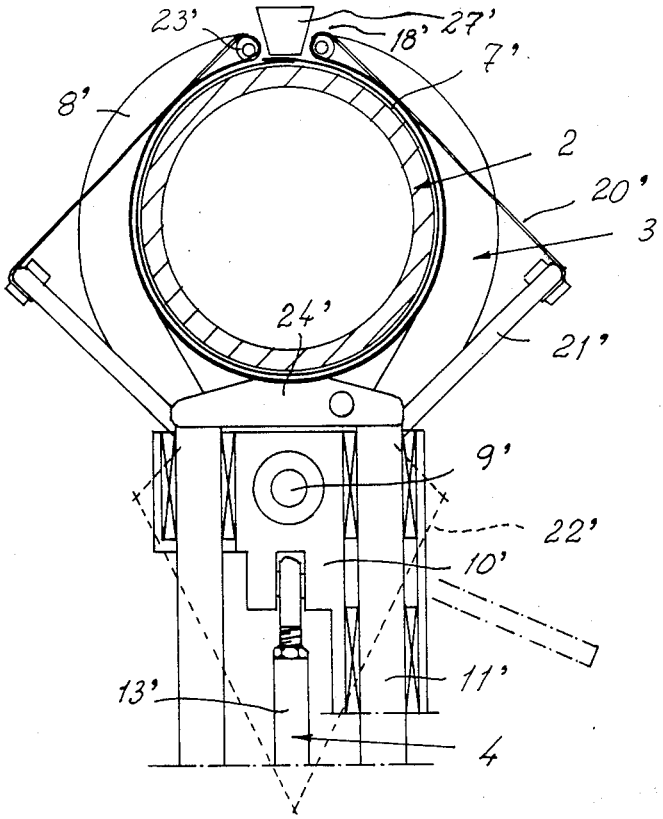
Figure 5:
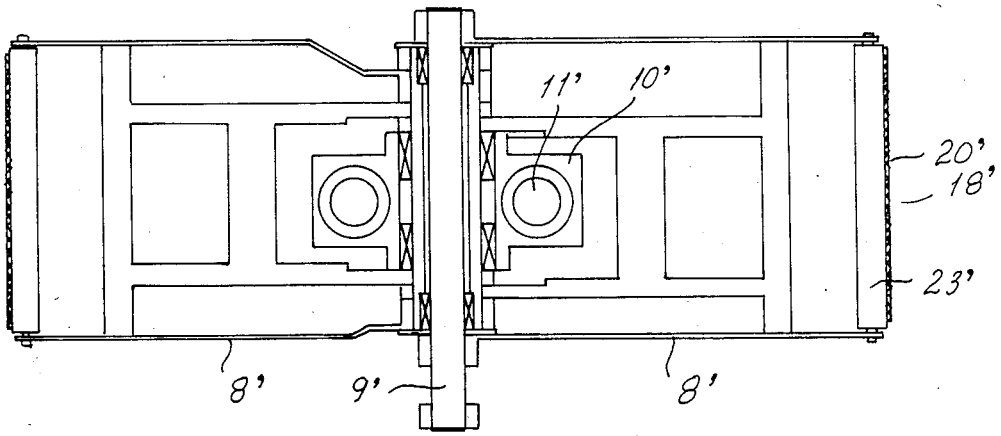

In the drawings FIG. 1 is a vertical cross section through an apparatus according to the invention in a position for sweeping a sleeve blank round a fixed mandrel. FIG. 2 correspondingly shows the apparatus after the sweeping operation is completed and in a position for sealing the container sleeve. FIG. 3 is a cross section in a side view of the apparatus of FIG. 1, seen along line III—III. FIG. 4 is a vertical cross section through an alternative embodiment of the apparatus according to the invention, and FIG. 5 is a top view of the apparatus according to FIG. 4.

The apparatus shown in FIGS. 1 and 2 generally comprises a carrier 1 for a plane sleeve blank, a fixed mandrel 2 on which a sleeve blank is adapted to be formed to an integral container sleeve, a pair of sweeping arms 3, a means 4 for raising and lowering the sweeping arms and a means 5 for rotating the sweeping arms.

The carrier 1 for the sleeve blank is in the form of a pair of rails 6 which are fixedly mounted in the machine and along which a plane sleeve blank 7 is fed from alongside the sleeve forming apparatus and in the actual direction of the mandrel 2. The rails 6 are provided on opposite sides of the mandrel and so as to allow a free movement upwards and downwards respectively of the sweeping arms 3.

The mandrel 2 is likewise fixedly mounted in a machine support (not shown) and in a position between the rails 6 and above the sweeping arms. The mandrel 2 may have very varied shape, for instance oval, elliptical, circular, polygonal with rounded corners etc. and it may even be conical in the actual direction. The most usual form and the form which is most simple to handle, however, is the circular-cylindrical form. The mandrel preferably is mounted so that it can easily be removed, whereby a mandrel of a specific shape and size can be substituted for a mandrel having another shape or another size.

The sweeping arms 3 are mounted symmetrically with reference to the longitudinal axis of the mandrel 2 and so that the arms can be moved up and down at the same time as the arms are rotated between an open down position which is shown in FIG. 1 and a closed upright position which is shown in FIG. 2. Each sweeping arm 8 is mounted for rotation on a rotatable shaft 9 in a carrier 10 which is vertically displaceable on two guide bars 11 of the machine support. The swinging shafts 9 are rotatably mounted in the carrier 10. An actuation bar 12 is fixed to each swinging shaft 9 for providing a swinging movement of the sweeper arms 8 upon actuation.

The carrier 10 is connected to an actuation arm 14 through a link 13, and by means not shown in the drawings said actuation arm 14 is adapted to move vertically up and down in relation to the fixed mandrel 2, to move towards and from the mandrel at its underside through a distance which is at least equal to the diameter of the mandrel. Each actuation bar 12 which is fixedly mounted on a swinging shaft 9 for a sweeper arm 8 is at its outer end formed with a guide roller 15 which is slideable in a guide block 16 having guide grooves 17. The guide block 16 is fixedly mounted in the machine support. Each guide groove 16 and its cooperating guide roller 15 thus comprise cooperating fixed and movable guide elements, there being a fixed and a movable guide element for each sweeping arm 8 of which the fixed guide element 16 is stationary with respect to the mandrel while the movable guide element 15 is spaced from the axis of the swinging shaft 9 about which its sweeping arm swings and is so connected with its sweeping arm 8 as to constrain that sweeping arm to swing about that axis with it. Of the pair of cooperating guide elements 15, 16 for each sweeping arm, one has a curving edge portion which is at all times slidingly engaged by the other as the carrier 10 moves towards and from the mandrel 2 to thus control the positions of swinging of the outer ends 18 of the sweeping arms as the shafts 9 are translated towards and from the mandrel. As here shown, said curving edge portion is on the fixed guide element 15 and is defined by its guide groove 17. The form of the guide groove depends on the form and size of the mandrel 2 and the groove is formed so that the outer ends of the sweeper arms 8 move closely along or press the sleeve blank 7 lightly to the mandrel 2 at least during a part of the sweeping movement. The guide grooves which thereby provide a positive guide movement of the sweeper arms 8 always should be formed so that the ends 18 of the sweeper arms 8 at the final point of the sweeping movement are located close to each other at the upper side of the mandrel 2. In case the sleeve is joined by a lap joint or by means of a joining strip provided along the inner surface of the sleeve the guide grooves 17 further should be formed so that the inner part of the lap joint or the sleeve blank edge bearing the joining strip, respectively, is always pressed to the mandrel before the other sleeve blank edge.

In the right hand part of FIG. 1 the form of a guide groove **17*a* is diagrammatically illustrated that provides a pressing of the sleeve blank 7 from a line substantially corresponding to the center of the cylindrical mandrel 12. It is evident that a first part (the lower part) of the groove extends vertically whereas the groove at the end of the movement upwards of the sweeper arms 8 is bowformed so that the outer ends 18** of the sweeper arms exactly follow the outer surface of the mandrel.

In the lefthand part of FIG. 1 a guide groove **17*b* is likewise diagrammatically illustrated which groove is bowformed so that the outer ends 18 of the sweeper arms 8 move close to or are pressed to the mandrel 2** from a point adjacent the lower side of the mandrel as far as to a point adjacent the upper most surface of the mandrel.

It is obvious that the sweeper arms may be brought to move along any actuation path by changing the form of the guide grooves 17. By further changing the stroke for the vertical displacement of the actuation arm 14 of the carrier 10 it is also possible to change the length of the vertical displacement. By two simple operations it is thereby possible to carefully adapt the movement of the outer ends 18 of the sweeper arms 8 to a mandrel 2 having different form and size. In FIG. 1 the reference numeral 19 indicates the smallest size of a mandrel for which the specific apparatus shown in the drawings has been adapted.

The sweeper arms 8 cooperate with a sweeper band 20 for sweeping a container blank 7 round the mandrel. Each outer end of the sweeper band 20 is mounted in a spring arm 21 intended to keep the band stretched in all positions of the sweeper arms 8. Each spring arm 21 is rotatably mounted on the swinging shaft 9 for the sweeper arm 8, and the spring arms 21 are actuated in the direction outwards-downwards by tension springs 22. The sweeper band 20 extends from the ends of the spring arms 21 over a roller 23 at the end of each sweeper arm 8 and provides a continuous sling between the spring arms. The central point of the sweeper band 20 is mounted in a fixed press device so that the band 20 can not be displaced in relation to the mandrel and the sleeve blank while sweeping said sleeve blank round the mandrel.

The press device comprises a press arm 24 which is mounted on a rotatable pin 25 and which at the top has a press-body 26 providing a press locking of a container sleeve 7 to the mandrel 2 when the pin 25 is rotated with the arm 24. Thereby a displacement of the blank in relation to the mandrel is prevented during the sweeping operation. As previously mentioned the sweeper band 20 is mounted in the press-body 26 for preventing a displacement of the band in one direction or the other in connection with the sweeping operation.

For joining of the sleeve blank 7 after it has been swept round the mandrel the apparatus includes a sealing block 27 provided above the mandrel and movable between an upper position in which the sleeve blank can be freely swept round the mandrel 2 and a lower position in which the sealing block 27 presses the sleeve blank to the mandrel. The sealing block may be a heated block which by constant heat, high frequency heat or ultrasonic heat provides a weldjoining of the sleeve blank edges, or it may be a cold press block which by means of a pressure sticking glue joins the two edges of the sleeve blank. Preferably the sleeve blank is formed with a weldable material like a weldable plastic material at one or both edges, and said weldable material makes it possible to join the two edges of the sleeve by a simple overlap weldjoint. In a preferred embodiment the sleeve blank is at one end formed with a projecting weldable strip attached to the inner surface of the sleeve to be formed. By means of said weldable strip the sleeve can be joined edge to edge (butt joint).

The apparatus shown in FIGS. 4 and 5 differs from the above described apparatus mainly in that the two sweeper arms are mounted on a common shaft 9'. Otherwise the apparatus works in the same way as the previously described apparatus.

The function of the appatratus is as follows;

The starting position of the apparatus is shown in FIG. 1, in which the sweeper arms 8 are located in their lower positions and the press device 24, 26 is retracted from the mandrel 2. Depending on the form of the guide grooves 17*a* or 17*b* the sweeper arms 8 take the position shown in the right hand part or the left hand part respectively of FIG. 1. A sleeve blank 7 is fed to a position underneath the mandrel 8 and is kept in a predetermined position by the carrier rails 6. The press device 24, 26 is rotated to its upper position together with the band which is fixedly mounted thereon, whereby the press-block 26 together with the band presses the sleeve blank 7 against the mandrel 2. Thereafter the actuation arm 14 is moved up so that the link 13 and the carrier 10 together with the sweeper arms 8 are moved upwards. Depending on the form of the guide grooves 17 the sweeper arms 8 are moved according to a predetermined path while being moved upwards, and the sweeper band 20 sweeps the container blank 7 round the mandrel 2. In the case illustrated in the right hand part of FIG. 1 the ends 18 of the sweeper arms do not get in contact with the mandrel 2 until at a line substantially at the center of the mandrel, in the left hand case of FIG. 1 the ends 18 of the sweeper arms get into contact with the mandrel already adjacent the bottom surface thereof. Of course the two sweeper arms 8 should be actuated by mirror symmetrical guide grooves 17 so that said arms obtain substantially the same scheme of movement. As previously mentioned, however, one edge of the sleeve blank should be moved slightly in advance of the other edge, so that the edges to be joined are located over each other. This is important whether the joint is made as an overlap joint or an edge to edge butt joint by means of an inner joining strip. The guide blocks 16 with the guide grooves 17 should be adjusted so that the sweeper arms 8 with a slight pressure keep the container blank pressed to the mandrel 2. When the container blank is completely swept round the mandrel and the joining edges have been put over each other the sealing block is moved down and the blank is joined to provide a sealing unit. After the different parts of the apparatus have returned to their starting positions the container sleeve is released from the mandrel and is formed with bottom, is filled and is sealed with a top closure.

When changing the form and size of sleeve the mandrel is exchanged for another mandrel and the stroke of the link 13 and the adjustments of the guide blocks 16 are adjusted in accordance with the new mandrel. If the form of the sleeve is changed it may be necessary to substitute the guide blocks for guide blocks having another form of the guide grooves 17.

I claim:

1. Apparatus for the manufacture of tubular container sleeves, each having a rounded cross-section and formed from an initially flat blank of sheet material that has a pair of opposite edge portions, said apparatus comprising a fixed mandrel which has a mandrel axis between a pair of opposite sides thereof and which has said cross-section and is thus adapted to have a blank swept therearound to be formed to said cross-section with its said edge portions adjacent to one another over one of said sides of the mandrel, sealing means at said one side of the mandrel movable towards and from the mandrel for clampwise cooperation with it whereby said edge portions of a blank wrapped around the mandrel are sealed to one another, and a pair of sweeper arms for sweeping a blank around the mandrel, each having an inner end and an outer end, said apparatus being characterized by:

(A) a carrier at the other of said opposite sides of the mandrel, confined to motion in opposite directions towards and from the mandrel through a distance at least equal to the diameter of the mandrel;

(B) shaft means on said carrier, constrained to motion in said opposite directions therewith and to which each sweeper arm is connected at its inner end, said shaft means defining for each sweeper arm a swinging axis parallel to said mandrel axis that is adjacent to the inner end of the sweeper arm and about which its outer end swings while the sweeper arm moves with the carrier through said distance to have its outer end carried to and from each of said sides of the mandrel;

(C) cooperating fixed and movable guide elements for each sweeper arm, (1) the fixed guide element being fixed in relation to the mandrel, (2) the movable guide element being spaced from the swinging axis of its sweeper arm and having a connection with its sweeper arm whereby the latter is constrained to swing about its swinging axis in unison with movement of the movable guide element about that axis, and (3) one of said guide elements having an edge portion which is at all times engaged by the other guide element as the carrier moves in said directions and which is so curved that during substantially the final half of the movement of the outer end of the sweeper arm from said other side of the mandrel to said one side thereof said outer end maintains constant engagement, through a blank, against the surface of the mandrel to press successive portions of the blank into contact with the mandrel; and (D) a sweeper band trained around the outer ends of the sweeper arms and having a portion extending between those outer ends under yielding tension to engage a blank and press successive portions of it into contact with the mandrel as the carrier moves in the direction towards the mandrel through substantially the first half of said distance.

2. The apparatus of claim 1 wherein said sweeper band is substantially inelastic and has opposite end portions, further characterized by:

sweeper band biasing means connected between each end portion of the sweeper band and said shaft means to maintain the sweeper band under lengthwise tension with its end portions extending away from the outer ends of the sweeper arms and the mandrel.

3. The apparatus of claim 2 wherein said sweeper band biasing means comprises:

(1) a spring arm for each sweeper arm, each spring arm having an inner end connected with said shaft means to be swingable about the same and having an outer end connected to an end portion of the sweeper band; and (2) a spring connected to the outer end of each spring arm to bias the same for swinging away from the mandrel.

4. The apparatus of claim 2, further characterized by:

a press device to which the sweeper band is fixed at a point on the sweeper band that is between the outer ends of the sweeper arms, said press device being movable toward and from engagement with the mandrel at said one side thereof.

* * * * *